US005941148A

United States Patent [19]

Miller et al.

[11] Patent Number: 5,941,148

[45] Date of Patent: Aug. 24, 1999

[54] AUTOMATIC SLITTER BLADE SHARPENER

[75] Inventors: William R. Miller, Portland, Oreg.; Richard M. Holbert, Washougal; Robert Shinn, Camas, both of Wash.; Semion Stolyar, Beaverton, Oreg.

[73] Assignee: Tidland Corporation, Camas, Wash.

[21] Appl. No.: 09/008,231

[22] Filed: Jan. 16, 1998

[51] Int. Cl.[6] ..... B26D 7/08

[52] U.S. Cl. ..... 83/174; 83/76.7; 451/419; 451/420

[58] Field of Search ..... 83/76.7, 76.1, 83/174, 174.1; 451/419, 420

[56] References Cited

U.S. PATENT DOCUMENTS

| | | | |
|---|---|---|---|
| Re. 35,086 | 11/1995 | Paulson et al. | 83/174 X |
| 1,263,450 | 4/1918 | Maimin | 83/174 X |
| 2,022,569 | 11/1935 | Molins | 51/247 |
| 2,026,096 | 12/1935 | Muhlbauer | 51/247 |
| 2,052,365 | 8/1936 | Stukart | 451/419 X |
| 2,337,183 | 12/1943 | Canning | 451/324 |
| 3,011,292 | 12/1961 | Sokso | 451/423 X |
| 3,459,086 | 8/1969 | Reeder, Jr. | 83/425 |
| 3,465,631 | 9/1969 | Reeder, Jr. | 83/500 |
| 4,347,771 | 9/1982 | Bradley | 83/174 |
| 4,373,302 | 2/1983 | Darby | 51/131.1 |
| 4,441,396 | 4/1984 | Mercier et al. | 83/174 X |
| 4,663,891 | 5/1987 | Gik et al. | 51/288 |
| 5,058,475 | 10/1991 | Tidland et al. | 83/481 |
| 5,090,281 | 2/1992 | Paulson et al. | 83/13 |
| 5,152,203 | 10/1992 | Wierschke | 83/174 X |
| 5,353,551 | 10/1994 | Nishida | 451/6 X |
| 5,435,217 | 7/1995 | Kato et al. | 83/174 X |
| 5,435,771 | 7/1995 | Gregory | 451/45 |
| 5,525,094 | 6/1996 | Pallmann | 451/45 |
| 5,711,696 | 1/1998 | Maeda et al. | 451/6 X |

FOREIGN PATENT DOCUMENTS

| | | | |
|---|---|---|---|
| 945662 | 1/1964 | United Kingdom | 83/174.1 |

*Primary Examiner*—M. Rachuba
*Attorney, Agent, or Firm*—Chernoff, Vilhauer,McClung & Stenzel, LLP

[57] ABSTRACT

A device for automatically sharpening the circular cutting edge of a disk-like blade while it is rotatably mounted in a blade cartridge is disclosed. The sharpener includes a coupling assembly adapted to matingly retain the cartridge in the same manner that it is retained in a slitter machine. A rotary drive assembly is adapted to engage with and rotate the disk-like blade while in the cartridge. A blade sharpening head is adapted to engage and sharpen the disk-like blade as the blade is being rotated by the rotary drive assembly.

10 Claims, 9 Drawing Sheets

AUTOMATIC SLITTER BLADE SHARPENER

BACKGROUND OF THE INVENTION

The present invention has to do with a device for automatically sharpening cartridge born slitter blades.

In a plant for manufacturing paper or other films or webs (for ease of description, the term "paper" will be used for all web materials), the paper is typically produced in large widths which are chosen for ease of handling in bulk. To produce paper in a desired set of smaller widths, a paper roll is unwound through a slitting machine, which slits the paper into the desired set of widths.

Referring to FIG. 1, a typical present day web slitting machine includes a number of web slitting assemblies, such as assembly 10, mounted on a transverse bar 14. Assembly 10 includes an upper carriage portion 16 and a blade cartridge 18, which includes a freely rotating disk-shaped slitter blade 20. The edge of blade 20 overlaps with a lower sharp-edged disk 22 so that together blade 20 and lower sharp-edged disk 22 present a scissors like action to a continuous web of material which is pulled through blade 20 and disk 22 by a drum or take-up reel (not shown). Blade cartridge 18 includes a dovetail channel 24 that engages with a dovetail bar 26 of upper carriage portion 16.

The advent of blade cartridges, such as cartridge 18, has greatly facilitated the sharpening of dull slitter blades. Prior to the introduction of blade cartridges, a slitter blade would be removed from its web slitting machine in a cumbersome operation, sharpened and replaced in a further cumbersome operation. With blade cartridges it is easy to snap a cartridge having a dull blade (a "dull cartridge") out of a machine, and quickly replace it with a cartridge having a sharp blade (a "sharp cartridge"). This approach minimizes machine down time and the labor of changing slitter blades. Dull cartridges are replaced by sharp cartridges from an inventory that is typically kept on hand near the web slitting machine. The dull cartridges are accumulated and taken to a shop where each blade is removed from its cartridge, sharpened by a skilled craftsman and reinstalled into a cartridge.

Although this system is a great improvement over previous systems, there are still significant problems. First, because an inventory of sharp cartridges must be kept on hand, the total number of cartridges that must be acquired is greater than would be necessary if the blades were sharpened more quickly and without the need for transport to a shop. Second, it is fairly expensive to sharpen blades manually, taking about 20 minutes of a skilled craftsman's time.

Although an automatic blade sharpener is highly desirable, a number of technical challenges must be met in order to create a practical device of this nature. First, an automatic blade sharpener ideally should easily accept and retain blades for sharpening. Second, the debris that is generated by the sharpening process must be prevented from disturbing the process. Third, there must be some way of controlling the process so that it produces a sharp blade without removing a great deal more blade material than is necessary. Finally, there must be some method of compensating for the increasing thickness of most slitter blades toward the blade center.

SUMMARY OF THE INVENTION

The present invention is a device for automatically sharpening the circular cutting edge of a disk-like blade while such blade is rotatably mounted in a blade cartridge having a coupling member shaped for detachable coupling matingly to a slitter machine. The device includes a rotary drive assembly that is adapted to engage with and rotate the disk-like blade and a blade sharpening head that is adapted to sharpen the circular cutting edge. The blade is held in place during this process by a coupling assembly that is shaped to detachably mate with the coupling member of the cartridge and thereby affix the cartridge to the device during the sharpening of the blade.

In an additional separate aspect of the present invention, a device for sharpening a circular cutting edge of a disk-like blade includes a back hone and a back hone drive assembly adapted to push the back hone into contact with the blade in a direction opposing the blade sharpening head in order to prevent the force of the sharpening head from deforming the circular cutting edge.

In a further additional separate aspect of the present invention, a device for sharpening a circular cutting edge of a disk-like blade having increasing thickness towards its center includes a sensor that detects the radial position of the cutting edge, and a control assembly responsive to the sensor that causes the sharpening head and the blade to engage each other with a variable force which increases automatically as the sensed radial position of the cutting edge approaches the center of the blade.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Referring to FIGS. 2–11, an automatic slitter blade sharpener 102 is provided to which blade cartridge 18 (first noted in the BACKGROUND OF THE INVENTION section) may be matingly attached so that slitter blade 20 may be sharpened to a predetermined cutting edge profile. The desired cutting edge profile is related to the type of paper or other web material to be cut. For each type of web material there typically is a well known optimum cutting edge profile.

Figure 1:
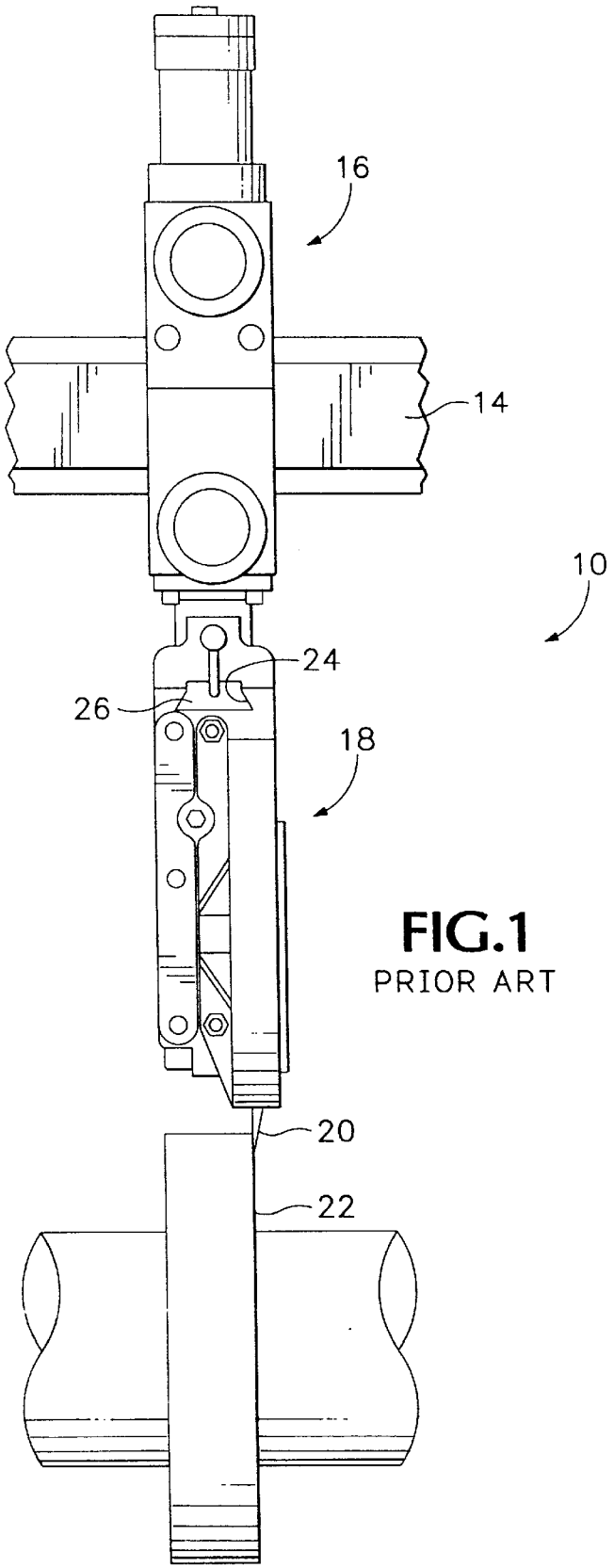
FIG.1 PRIOR ART
FIG. 1 is a front view of a prior art web slitting machine.
Figure 2:
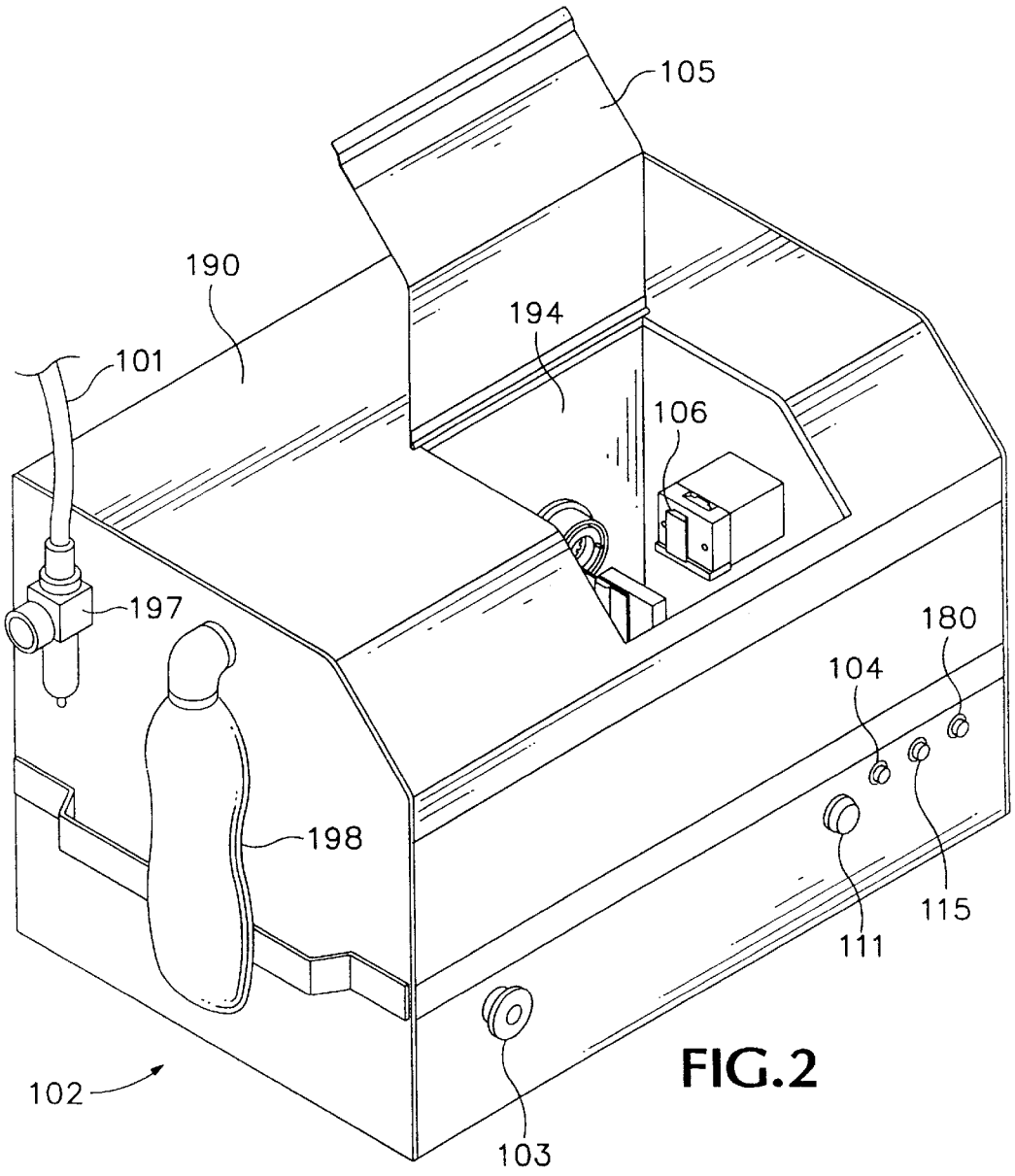
FIG. 2 is a perspective view of an exemplary automatic slitter blade sharpener according to the present invention.

Referring to FIG. 2, sharpener 102 is connected to an electric power source by a power cord (not shown) and a compressed air source at pneumatic port 101. A "power on" knob 103 is then pulled out, causing sharpener 102 to be reset into a state in which all assemblies are in their "ready" positions. Ready light 104 is illuminated if electric power and compressed air are properly connected.

The user then opens a lid 105 and manually slides dovetail channel 24 of cartridge 18 downwardly onto a mating dovetail bar 106 of a coupling assembly 107 (FIGS. 3, 5–8), until the channel 24 rests on top of a ledge 112. This automatically positions the cartridge 18 in a predetermined orientation with respect to the sharpener 102 without the need for any mechanical skill on the part of the user. The installation of cartridge 18 actuates a limit switch 108, which notifies a controller 109 (FIG. 11) of controller assembly 110 that a cartridge is installed. If limit switch 108 is not actuated, controller 109 blocks further operation. The user then closes lid 105, which engages a limit switch (not shown), which prevents operation of sharpener 102 when lid 105 is open, and presses an "on" button 111. In response an "in process" light 115 is illuminated. Controller 109 then commands an electrically controlled pneumatic valve bank 116 to actuate a pneumatic clamp cylinder 118, which locks cartridge 18 firmly in place by retracting dovetail bar 106, firmly affixing the cartridge in its predetermined orientation.

A dovetail bar support block 119 is removable to expose a second dovetail bar 120 that is available for attachment of blade cartridges similar to cartridge 18 but having a larger size and larger dovetail channel. Similar to bar 106, bar 120 is pneumatically retractable for matingly retaining slitter blade cartridges.

After cartridge 18 is mated to coupling assembly 107 blade 20 is engaged and rotated by a rotary drive assembly 132. To do this, controller 109 commands valve bank 116 to actuate a rotary drive assembly pneumatic cylinder 134 to push a rotation head positioning fork 136 forward. A set of low-friction replaceable brass wear pads 137 (FIGS. 7 and 8) attached to the two arms and the bridge portion of fork 136 fit into a circumferential groove in a rotation head 138 so that fork 136 can position and stay rotation head 138 while it is rotating. A protective tube 139 protects head 138 in its retracted state. Simultaneously, controller 109 commands DC motor 140 to rotate head 138 by way of worm gear speed reducer 141 and a splined drive shaft 142. Drive shaft 142 telescopingly engages the rotation head interior splines 143 so that head 138 may be rotated and positioned or stayed by fork 136 independently. Head 138 is rotated and further advanced toward blade 20 so that a pair of spring loaded engagement pins 144 pop into a pair of mating apertures in blade 20 thereby engaging blade 20 and causing its rapid rotation.

Figure 3:
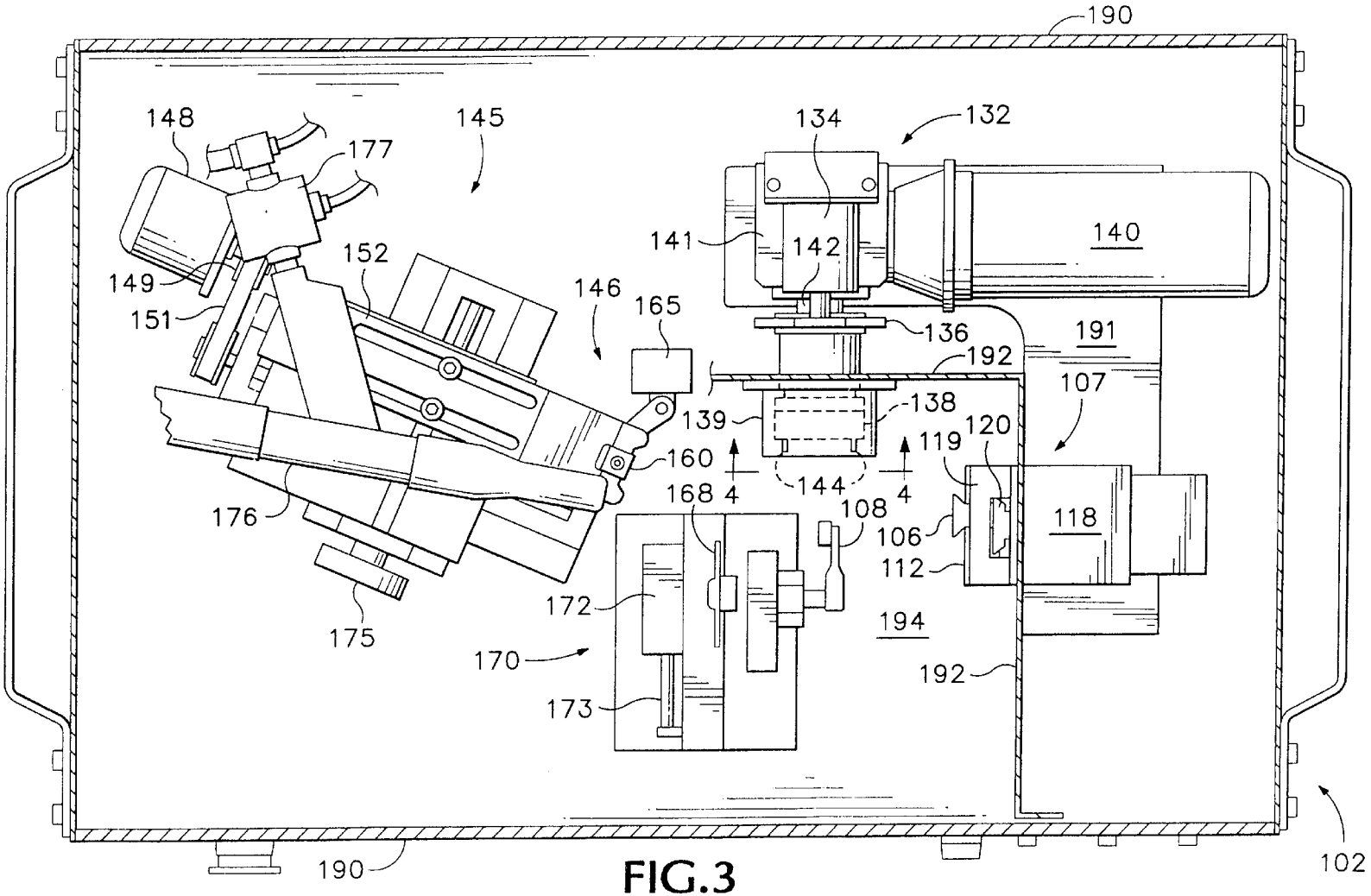
FIG. 3 is a partially sectional plan view of the interior of the automatic slitter blade sharpener of FIG. 2.

Then, controller 109 commands a sharpening head drive assembly 145 to push a sharpening head 146 toward slitter blade 20 in preparation for engaging and sharpening blade 20. Referring to FIG. 3, sharpening head drive assembly 145 includes a stepping motor 148 that rotates an output pulley 149 in response to a sequence of electric pulses received from controller assembly 110. Controller assembly 110 includes a driver 150 that applies pulses to stepping motor 148 in response to a command from controller 109. A drive belt assembly 151, conveys power from stepping motor 148 to an X-Y table 152 that moves sharpening head 146 linearly toward or away from blade 20 in response to the rotational movement of pulley 149.

Additionally, controller 109 activates a laser 154 (FIG. 11) that transmits into an optical fiber 156 (FIG. 9), which in turn, projects a laser beam 158 coincident with the cutting surface of a ceramic cutting block 160. Beam 158 is broken by a cutting edge 163 of blade 20 when block 160 is poised at edge 163. An optical sensor 164 detects the absence of the laser beam 158 and relays this information to controller 109. In response to the breaking of laser beam 158 controller 109 halts the preparatory advance of sharpening head 146. A sharpening head advance limit switch 165 prevents sharpening head 146 from being advanced beyond the furthest point where a blade could possibly be encountered.

Next, controller 109 commands stepping motor 148 to advance a predetermined number of steps, causing drive assembly 145 to push cutting block 160 into blade 20. In this operation metallic drive assembly 145 acts as a slightly yieldable spring, storing mechanical energy from stepping motor 148 by a slight compression of assembly 145 and gradually decompressing and releasing energy through the advance of cutting block 160.

Figure 9:
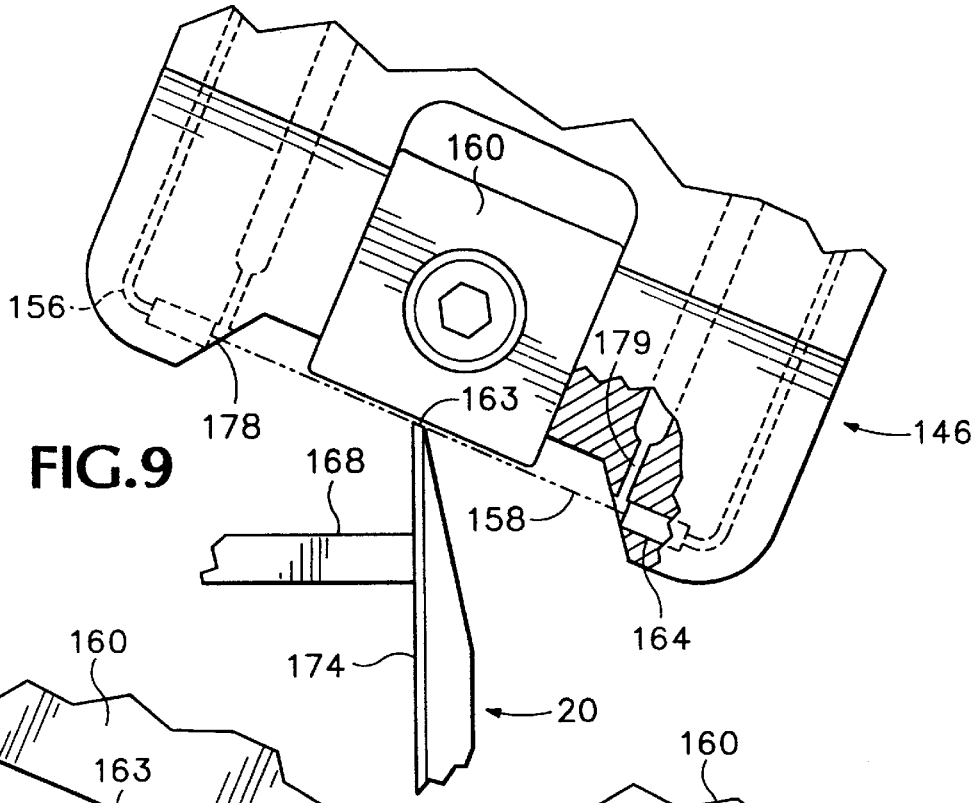
FIG. 9 is an enlarged top view of the sharpening head of the automatic slitter blade sharpener of FIG. 2 poised to make contact with a slitter blade.
Figure 10A:
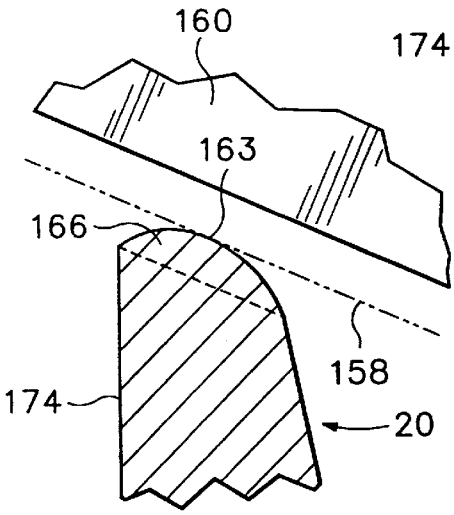
FIG. 10*a* is a greatly enlarged top view of the cutting block of the automatic blade sharpener of FIG. 2 poised to make contact with a slitter blade.
Figure 10B:
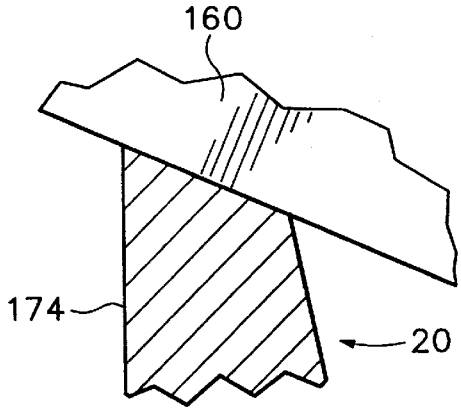
FIG. 10*b* is a greatly enlarged top view of the cutting block of the automatic blade sharpener of FIG. 2 contacting a slitter blade.
Figure 4:
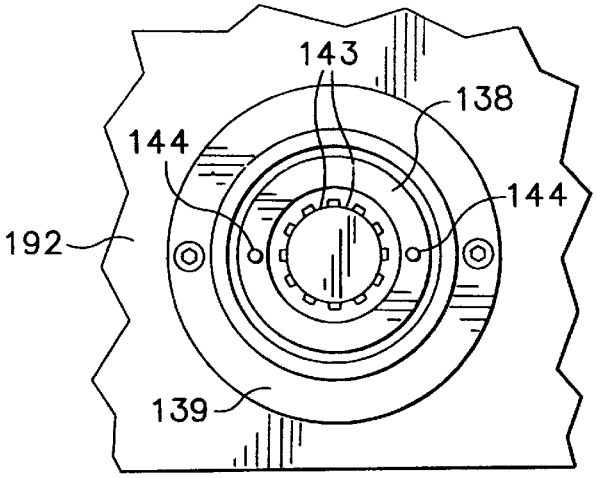
FIG. 4 is a side view of the rotation head of the automatic slitter blade sharpener of FIG. 2 taken along line 4—4 of FIG. 3.
Figure 5:
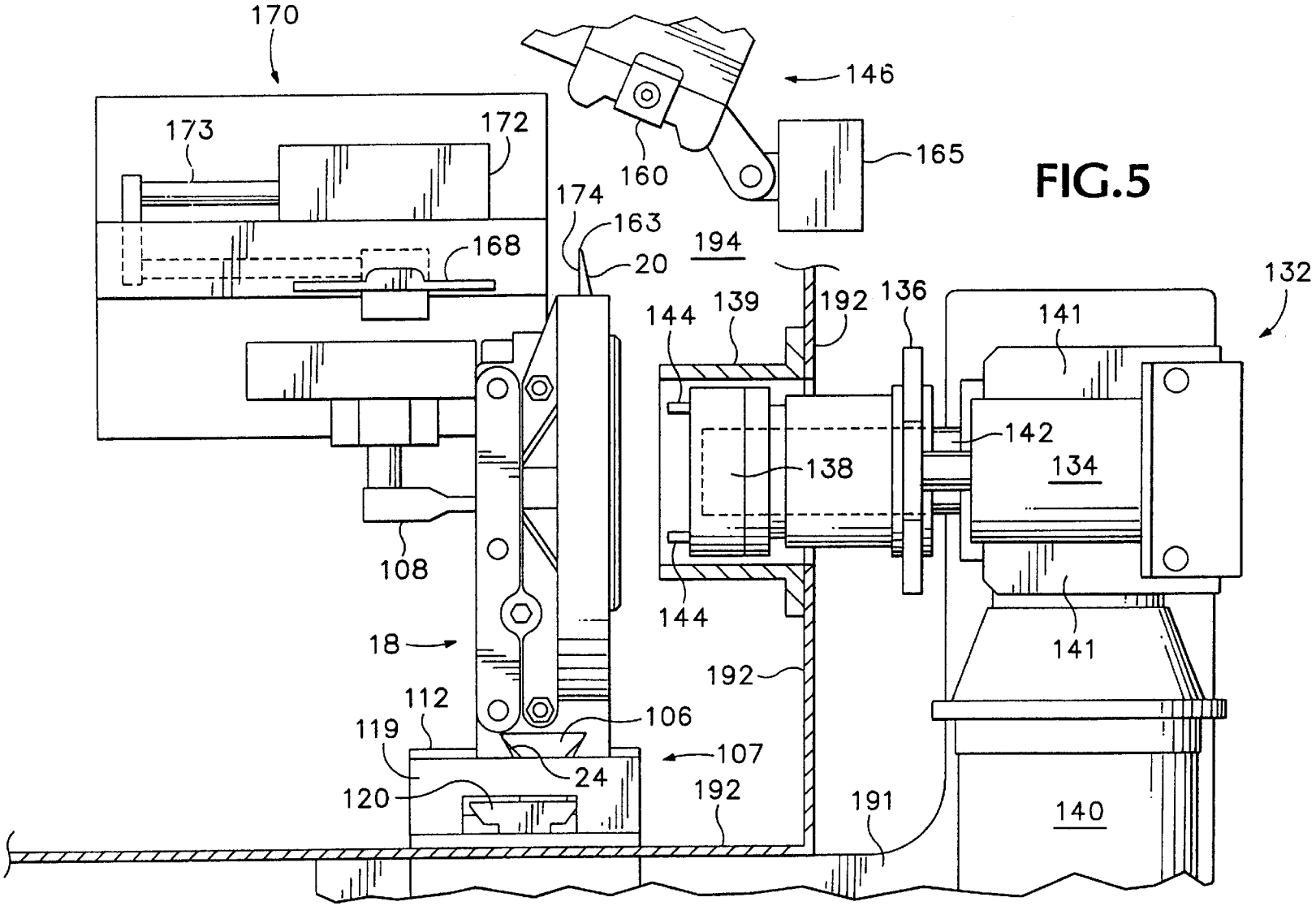
FIG. 5 is an enlarged, partially sectional plan view of the sharpening chamber of the automatic slitter blade sharpener of FIG. 2 with a slitter blade cartridge detachably mated to the coupling assembly prior to sharpening.
Figure 6:
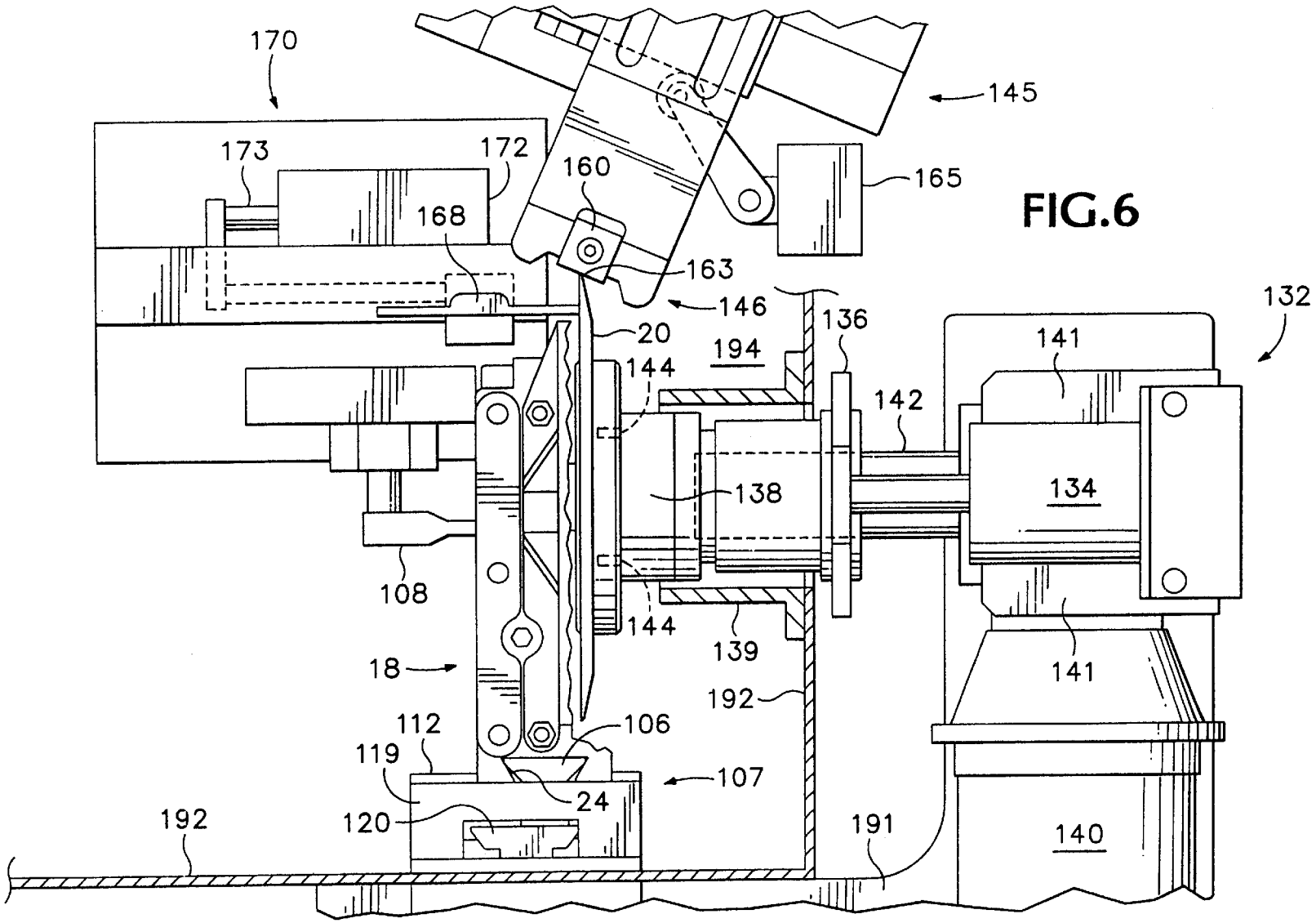
FIG. 6 is an enlarged, partially sectional plan view of the sharpening chamber of the automatic slitter blade sharpener of FIG. 2 with a slitter blade cartridge shown during the sharpening process.
Figure 7:
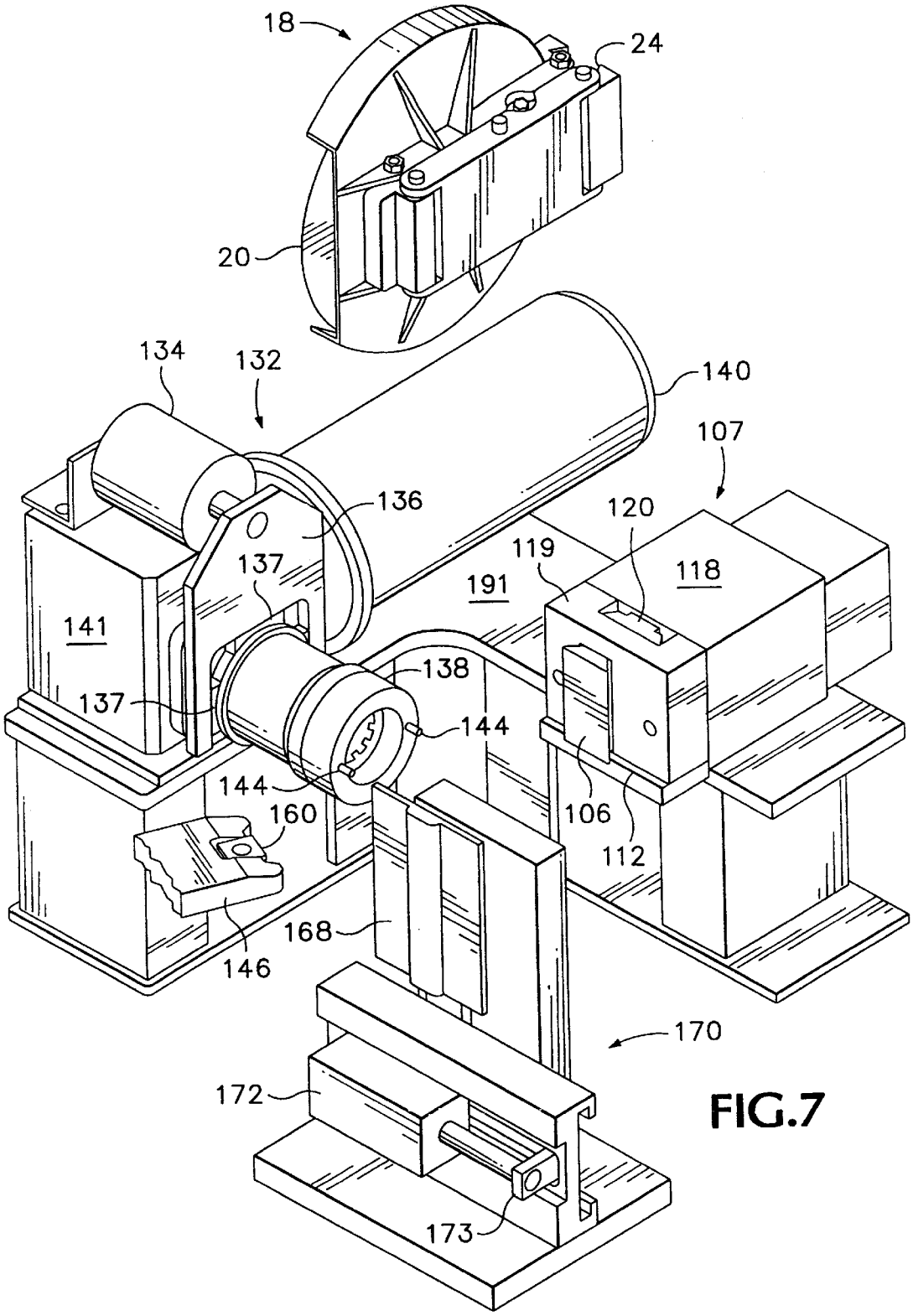
FIG. 7 is an isometric partial view of the sharpening chamber of the automatic slitter blade sharpener of FIG. 2, with side walls removed for clarity and a slitter blade cartridge positioned above the coupling assembly preparatory to mating therewith.
Figure 8:
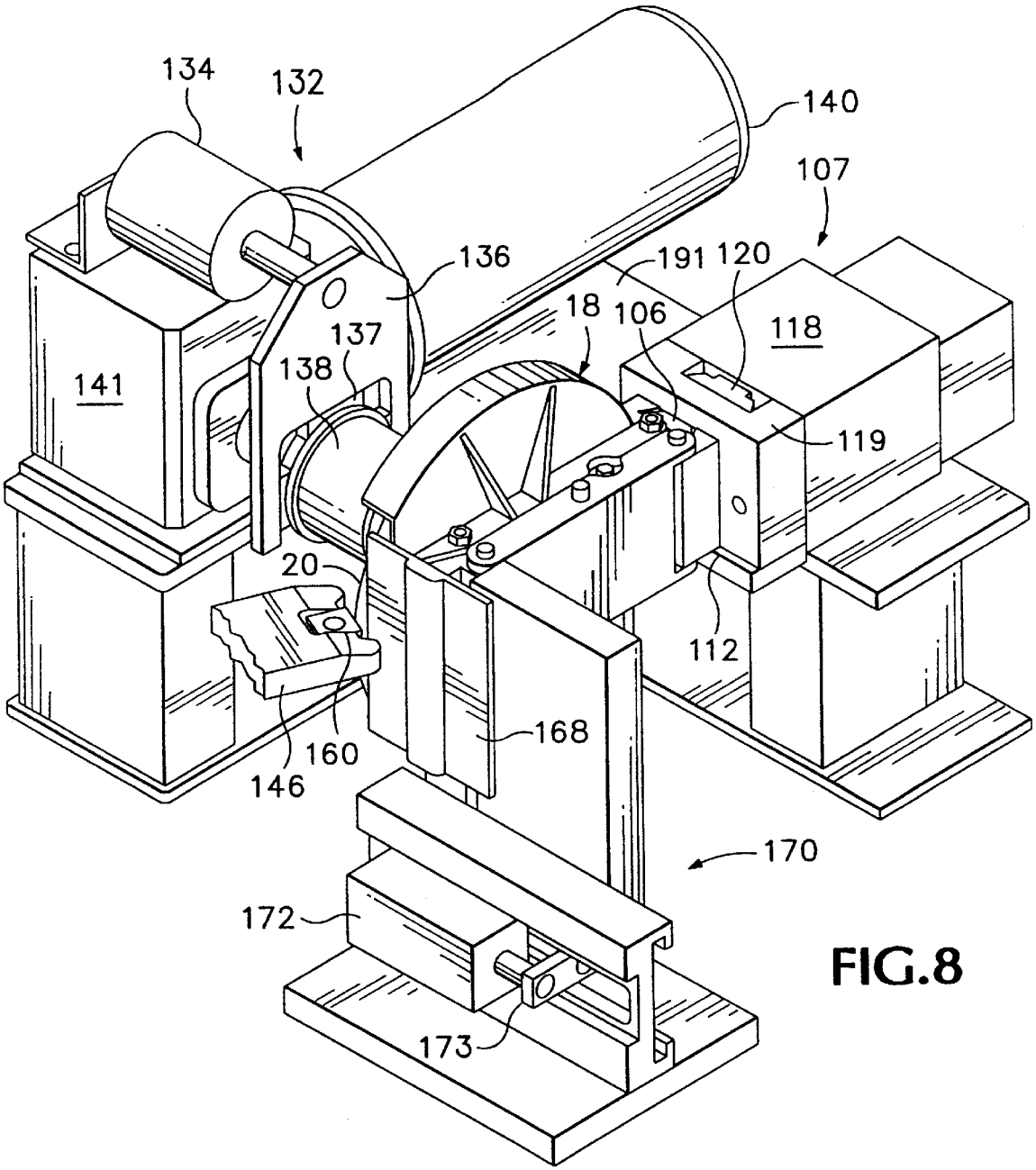
FIG. 8 is an isometric view of the sharpening chamber of FIG. 7 with a slitter blade cartridge mated to the coupling assembly during sharpening.
Figure 11:
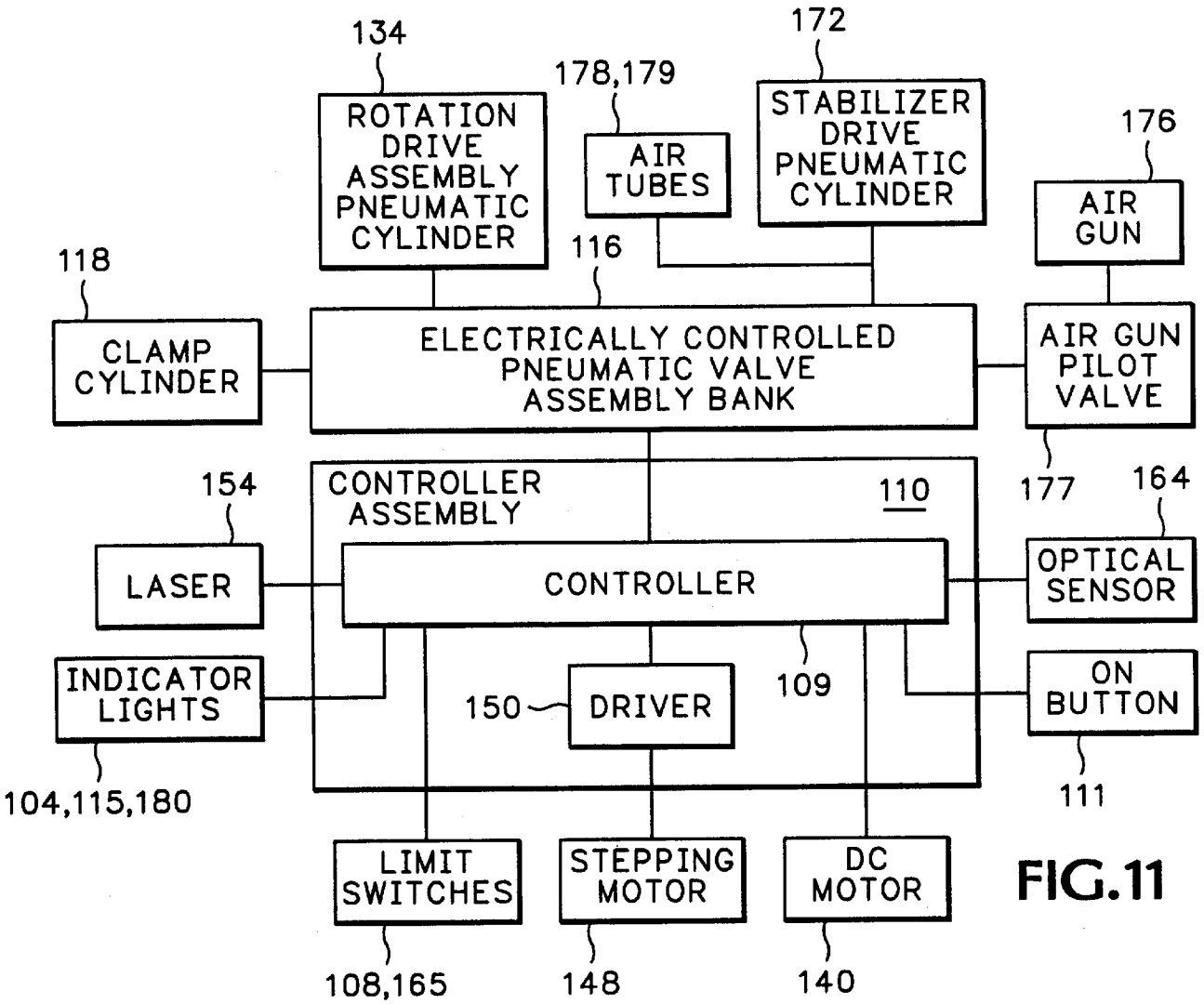
FIG. 11 is a block diagram of the control assembly and associated elements of the automatic blade sharpener of FIG. 2.

Referring to FIGS. 9–10*b*, block 160 is canted at the angle of the desired cutting edge profile. As block 160 advances into blade 20 it cuts away a region of excess material 166 that is shown in shading in FIG. 10*a*, to leave the desired cutting edge profile. As only the location of edge 163 is determined by optical sensor 164, the controller 109 is programmed to command stepping motor 148 to advance a distance that is guaranteed to restore sharpness to even a very dull blade.

To facilitate the sharpening operation, controller 109 commands a back hone 168 to brace blade 20. Back hone 168 is supported and driven by a back hone drive train 170 having a back hone drive pneumatic cylinder 172 that positions back hone 168 by way of a U-shaped bracket 173. During the cutting operation, controller 109 commands a valve bank 116 to actuate cylinder 172 and thereby press back hone 168 into an unbevelled major surface 174 of blade 20.

The presence of back hone 168 addresses two major potential problems. First, the force applied by cutting block 160 causes cutting edge 163 to deform or curling slightly away from block 160. Cutting edge 163 contacts and is straightened by back hone 168 directly before and directly after cutting edge 163 contacts cutting block 160. Back hone 168 is also slightly abrasive so that it helps to sharpen or hone cutting edge 163. Second, cutting block 160 applies enough force to blade 20 to potentially cause blade 20 to bend, break or be rotated slightly transversely to its axis of rotation. Back hone 168 braces blade 20 against this force, to present a good cutting resistance to block 160.

An x-y table manual adjustment knob 175 (FIG. 3) permits a user to adjust the position of ceramic cutting block 160 transversely to its axis of movement towards blade 20.

This adjustment is performed between sharpening operations so that a different portion of block 160 will contact the next blade to be sharpened, thereby permitting block 160 to wear evenly. In an alternative embodiment this adjustment is performed automatically by a second stepping motor.

Controller 109, by way of valve bank 116, activates an air suction gun pilot valve 177 which causes air suction gun 176 (FIGS. 3 and 11) to draw a suction for removing the cuttings from blade 20 out of sharpener 102. Such contaminants could occlude laser beam 158 and generally interfere with the cutting process. As an additional protection against such interference, a pair of air pressure tubes 178 and 179 (FIG. 9) terminate in sharpening head 146 to blow any cuttings away from the terminus of optical fiber 156 and optical sensor 164, respectively.

Typically, for increased strength, slitter blades are progressively thicker near the center. Where blade 20 is thicker, ceramic cutting block 160 must press against cutting edge 163 with greater force to remove an equal depth of material. For this reason, controller 109 commands stepping motor 148 to advance a greater number of steps in inverse relation to the radial distance between cutting edge 163 and the center of blade 20. This does not necessarily cause a greater thickness of material to be removed from cutting edge 163 because the minimum force required to cause cutting block 160 to cut at all into blade 20 is greater toward the center of blade 20. This minimum force determines the flexure in the mechanical train of assembly 145 at the time when block 160 stops cutting and blade 20 is rotated through a number of smoothing rotations in which block 160 is in a dwell state. Consequently, although stepping motor 148 is commanded to advance a greater number of steps, block 160 typically does not advance a further distance.

Controller assembly 110 commands sharpening head drive assembly 145 to retract sharpening head 146 to a rest position, commands motor 140 to deactivate and cease rotation of blade 20 and then commands valve bank 116 to cause pneumatic cylinders 134 and 172 to pull rotation head 138 and back hone 168 away from engagement with blade 20. Controller 109 also commands pneumatic clamp cylinder 118 to release dovetail bar 106 from its retracted state, thereby loosening the connection between bar 106 and cartridge 18. At this point controller 109 commands the illumination of a "finished" light 180, that lets the user know that the process is completed, blade 20 is sharpened and cartridge 18 is ready for removal from sharpener 102.

Referring to FIG. 2, a housing 190 blocks the cuttings from blade 20 that otherwise would fly outwardly from sharpener 102 and potentially injure personnel. An L-shaped base 191 supports coupling assembly 107 and rotary drive assembly 132. Interior walls 192 likewise support internal workings and define a sharpening chamber 194. An air regulator 197 delivers regulated compressed air to sharpener 102 and a vacuum bag 198 catches and retains cuttings from blade 20.

Controller 109 may be a Mitsubishi PLC Controller, model number FX48MR-ZS and driver 150 is also made by Mitsubishi with model number FXIPG.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A device for automatically sharpening a circular cutting edge of a disk-like blade while said blade is rotatably mounted in a blade cartridge having a coupling member shaped for detachable coupling matingly to a slitter machine, said device comprising:

(a) a rotary drive assembly adapted to engage with and rotate said disk-like blade while said disk-like blade is mounted in said blade cartridge;

(b) a blade sharpening head adapted to sharpen said circular cutting edge as said disk-like blade is being rotated by said rotary drive assembly; and (c) a coupling assembly, shaped to detachably mate with and clamp said coupling member, and thereby affix said blade cartridge, to said device during sharpening of said disk-like blade.

2. The device of claim 1 wherein said coupling member and said coupling assembly have respective mating shapes which automatically predetermine an orientation of said blade cartridge relative to said coupling assembly.

3. The device of claim 1, further comprising a back hone and a back hone drive assembly adapted to push said back hone into contact with said disk-like blade in a direction opposing said blade sharpening head to prevent said blade sharpening head from deforming said circular cutting edge.

4. The device of claim 3 wherein said back hone is abrasive.

5. The device of claim 1, further including a sensor that detects the radial position of said circular cutting edge and a control assembly that causes said sharpening head and said disk-like blade to engage each other with a variable force which increases automatically in response to said sensor as the sensed radial position of said circular cutting edge approaches said center of said disk-like blade.

6. A device for automatically executing a sharpening operation adapted to sharpen a circular cutting edge of a disk-like blade while said blade is rotatably mounted in a blade cartridge having a coupling member shaped for detachable coupling matingly to a slitter machine, said device comprising:

(a) a rotary drive assembly adapted to engage with and rotate said disk-like blade while said disk-like blade is mounted in said blade cartridge;

(b) a blade sharpening head adapted to sharpen said circular cutting edge as said disk-like blade is being rotated by said rotary drive assembly; and (c) a coupling assembly, shaped to detachably mate with and affix said coupling member, and thereby said blade cartridge, to said device during sharpening of said disk-like blade; and (d) a control assembly operatively connected to said rotary drive assembly and said blade sharpening head and adapted to control said rotary drive assembly and said blade sharpening head to execute said sharpening operation.

7. The device of claim 6 further including an manual input device operatively connected to said control assembly and adapted to prompt said control assembly to begin said sharpening operation.

8. A device for automatically sharpening a circular cutting edge of a disk-like blade while said blade is rotatably mounted in a blade cartridge having a coupling member shaped for detachable coupling matingly to a slitter machine, said device comprising:

(a) a rotary drive assembly adapted to engage with and rotate said disk-like blade while said disk-like blade is mounted in said blade cartridge;

(b) a blade sharpening head adapted to sharpen said circular cutting edge as said disk-like blade is being rotated by said rotary drive assembly;

(c) a coupling assembly, shaped to detachably mate with and affix said coupling member, and thereby said blade cartridge, to said device during sharpening of said disk-like blade; and (d) an enclosure, partially enclosing said rotary drive assembly, said blade sharpening head and said coupling assembly.

9. The device of claim 8, further comprising a closure operatively connected to said enclosure and adapted to be placed in a closed state by a user to thereby substantially enclose said rotary drive assembly, said blade sharpening head and said coupling assembly and also adapted to be placed in an open state by a user.

10. The device of claim 9, further comprising an interlocking means operatively connected to said closure and adapted to prevent activation of said rotary drive assembly if said closure is in said open state.

* * * * *